US009453312B2

(12) United States Patent
James et al.

(10) Patent No.: US 9,453,312 B2
(45) Date of Patent: Sep. 27, 2016

(54) ENERGY ABSORPTION DEVICES

(75) Inventors: Dallas Rex James, Auckland (NZ); Jason Paul Rogers, Pukekohe (NZ)

(73) Assignee: VALMONT HIGHWAY TECHNOLOGY LIMITED, Auckland (NZ)

( * ) Notice: Subject to any disclaimer, the term of this patent is extended or adjusted under 35 U.S.C. 154(b) by 248 days.

(21) Appl. No.: 13/362,662

(22) Filed: Jan. 31, 2012

(65) Prior Publication Data

US 2013/0140510 A1 Jun. 6, 2013

(30) Foreign Application Priority Data

Feb. 2, 2011 (NZ) ..... 590876
Dec. 23, 2011 (NZ) ..... 590876

(51) Int. Cl.
*E01F 15/00* (2006.01)
*E01F 15/02* (2006.01)
*E01F 15/04* (2006.01)
*E01F 15/14* (2006.01)

(52) U.S. Cl.
CPC ..... *E01F 15/02* (2013.01); *E01F 15/0423* (2013.01); *E01F 15/0438* (2013.01); *E01F 15/143* (2013.01); *E01F 15/146* (2013.01)

(58) Field of Classification Search
CPC ..... E01F 15/00; E01F 15/02; E01F 15/025; E01F 15/04; E01F 15/0407; E01F 15/0423; E01F 15/14; E01F 15/143; E01F 15/145; E01F 15/0438; E01F 15/043; E01F 15/146; E01F 15/148; E01F 15/06; E01F 15/0461
USPC ..... 404/10
See application file for complete search history.

(56) References Cited

U.S. PATENT DOCUMENTS 4,583,716 A * 4/1986 Stephens et al. ..... 256/13.1
4,674,911 A * 6/1987 Gertz ..... 404/6
4,739,971 A * 4/1988 Ruane ..... 256/13.1
4,823,923 A * 4/1989 Moyer ..... 188/376
4,844,213 A * 7/1989 Travis ..... 188/377
5,022,782 A * 6/1991 Gertz et al. ..... 404/6
5,217,318 A * 6/1993 Peppel ..... 404/6

(Continued)

FOREIGN PATENT DOCUMENTS

DE 19525243 A1 * 1/1997 ..... E01F 15/14
FR 2911351 A1 * 7/2008

(Continued)

*Primary Examiner* — Daniel P Stodola
*Assistant Examiner* — Matthew R McMahon
(74) *Attorney, Agent, or Firm* — Greer, Burns & Crain, Ltd.

(57) ABSTRACT

A slider assembly including a front section, and a back section, where the front section is adapted to conform to the cross sectional profile of rails forming the terminal end of a guardrail, or other barrier, to which the slider assembly will be fitted in use. The front section in combination with the back section create an internal space therebetween capable of substantially surrounding both an associated first rail and an associated second rail of the terminal end, and at least two further rails located downstream of the first and second rail. The slider assembly includes first and second opposed portions configured to move with respect to each other so the slider assembly can, in use, apply an increasing compressive force to telescoping rails as a consequence of the slider assembly travelling along one or more subsequent rail(s) during telescoping.

6 Claims, 5 Drawing Sheets

(56) References Cited

U.S. PATENT DOCUMENTS

| | | | | |
|---|---|---|---|---|
| 5,348,416 | A * | 9/1994 | Ivey et al. | 404/6 |
| 5,391,016 | A | 2/1995 | Ivey et al. | |
| 5,407,298 | A * | 4/1995 | Sicking et al. | 404/6 |
| 5,547,309 | A * | 8/1996 | Mak et al. | 404/6 |
| 5,660,496 | A | 8/1997 | Muller et al. | |
| 5,664,905 | A * | 9/1997 | Thompson et al. | 404/6 |
| 6,024,341 | A * | 2/2000 | Gertz | 256/13.1 |
| 6,179,516 | B1 * | 1/2001 | Ivey et al. | 404/6 |
| 6,715,735 | B2 * | 4/2004 | Bligh et al. | 256/13.1 |
| 6,783,116 | B2 * | 8/2004 | Albritton | 256/13.1 |
| 6,926,462 | B1 * | 8/2005 | Fuganti et al. | 404/6 |
| 7,101,111 | B2 * | 9/2006 | Albritton | 404/6 |
| 7,306,397 | B2 * | 12/2007 | Albritton | 404/6 |
| 7,325,789 | B2 * | 2/2008 | Buth et al. | 256/13.1 |
| 7,484,781 | B1 * | 2/2009 | Garber et al. | 293/133 |
| 7,794,174 | B2 * | 9/2010 | McKenney et al. | 404/6 |
| 7,926,790 | B2 * | 4/2011 | James | 256/13.1 |
| 8,388,259 | B2 * | 3/2013 | Amengual Pericas | 404/6 |
| 2005/0074190 | A1 * | 4/2005 | Traiser et al. | 384/21 |
| 2008/0224114 | A1 * | 9/2008 | Cheng | 256/19 |
| 2009/0206308 | A1 * | 8/2009 | Amengual Pericas | 256/13.1 |
| 2009/0302288 | A1 * | 12/2009 | James | 256/13.1 |
| 2012/0003039 | A1 * | 1/2012 | Wallace et al. | 404/6 |

FOREIGN PATENT DOCUMENTS

| | | |
|---|---|---|
| NZ | 539397 | 4/2005 |
| NZ | 548116 | 6/2006 |
| WO | WO 0102649 A1 * | 1/2001 |

* cited by examiner

ENERGY ABSORPTION DEVICES

RELATED APPLICATION

This application claims priority from New Zealand Provisional Application No. 590876 filed Feb. 2, 2011.

TECHNICAL FIELD

The specification includes a disclosure which relates to improvements in and relating to energy absorption devices. In particular the specification details guardrails and crash barriers although this should not be seen as limiting.

BACKGROUND ART

For ease of reference only the specification will now discuss the invention as it may pertain to guardrails however this should not be seen as limiting as the present invention can be employed in other energy absorbing applications.

Guardrails typically consist of a series of W beam rails longitudinally aligned and supported by a number of posts and are used on the sides of roads to help redirect errant vehicles back on to the road by acting as a side barrier. However, the terminal ends of guardrails pose a significant risk to occupants of oncoming vehicles should they have a head on impact with the terminal end of the guardrail. It will be understood, the risks associated with hitting a terminal end of a guardrail head on, are similar to those associated with hitting other stationary objects, such as trees or power poles.

There is therefore a need for a modified guardrail terminal end and components therefor which, can help a guardrail terminal end absorb the energy of a vehicle impact, to reduce the risk of injury to occupants of vehicles involved in a head on (end on) collision, with the terminal end of a guardrail.

It is desirable to address the foregoing problems or at least to provide the public with a useful choice.

Further aspects and advantages of the present invention will become apparent from the ensuing description which is given by way of example only.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art, in New Zealand or in any other country.

SUMMARY

According to one aspect of the present invention there is provided:

a slider assembly which includes:

a front section;

a back section, wherein the front section is adapted to conform to the cross sectional profile of rails forming the terminal end of a guardrail, or other barrier, to which the slider will be fitted in use; and wherein the front section in combination with the back section create an internal space there between, the internal space dimensioned, so as to in use, be capable of substantially surrounding both an associated first rail and an associated second rail of the terminal end, as well as at least two further rails located downstream of said first and second rail, wherein the slider assembly has first and second opposed portions and the slider assembly is configured so that the first and second opposed portions can move with respect to each other so the slider assembly can, in use, apply an increasing compressive force to telescoping rails as a consequence of the slider assembly travelling along one or more subsequent rail(s) during telescoping.

A slider assembly substantially as described above wherein the slider assembly has an upstream end and a downstream end and wherein back section is adapted to have a substantially horizontal slit therein which opens to an upstream edge of the back section.

A slider assembly which includes a slider substantially as described above and wherein the assembly includes a bracket and stop attached to the second rail which, in use, help retain the second rail within the internal space of the slider during side on impacts where the second rail may experience a longitudinal pulling force.

An energy absorbing apparatus substantially as described above which includes at least one slider assembly.

An energy absorbing apparatus wherein the energy absorbing apparatus is in the form of a guardrail.

According to a further aspect of the present invention there is provided a method of absorbing the energy of a head on impact with a guardrail which comprises the steps of:

a) using a friction brake which includes two opposed portions which together surround at least a portion of at least one rail and is capable of connecting at least two adjacent terminal rails of a guardrail so the rails and one or more subsequent sequentially adjacent rails can telescope in relation to one another and wherein said friction brake is configured so that the two opposed portions can move with respect to each other so the opposed portions of the slider assembly can progressively apply an increasing compressive force to the telescoping rails as the brake travels along the rails during telescoping.

Further aspects of the invention include:

A method of controlling the energy of an impact to decelerate a vehicle or other object comprising the step of:

a) manipulating the number, length and/or thickness of adjacent rails present at a terminal impact end of an energy absorbing apparatus.

An energy absorbing apparatus which includes at least one slider assembly comprising first and second opposed portions and the slider assembly is configured so that the first and second opposed portions can move with respect to each other so the slider assembly can, in use, apply an increasing compressive force to telescoping rails as a consequence of the slider assembly travelling along one or more subsequent rail(s) during telescoping.

An energy absorbing apparatus which includes two slider assemblies substantially as described above which are connected to one another in a manner which enables each of the connected slider assemblies to travel on two parallel sets of rails.

Several embodiments of the invention and advantages it provides will be further described in more detail below.

BRIEF DESCRIPTION OF DRAWINGS

Further aspects of the present invention will become apparent from the following description which is given by way of example only and with reference to the accompanying drawings in which.

DETAILED DESCRIPTION

Figure 1:
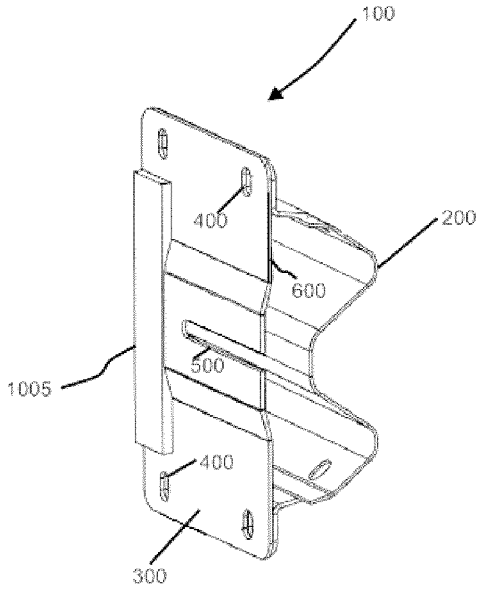
FIG. 1 shows a back perspective view of a slider in accordance with one preferred embodiment.
Figure 2:
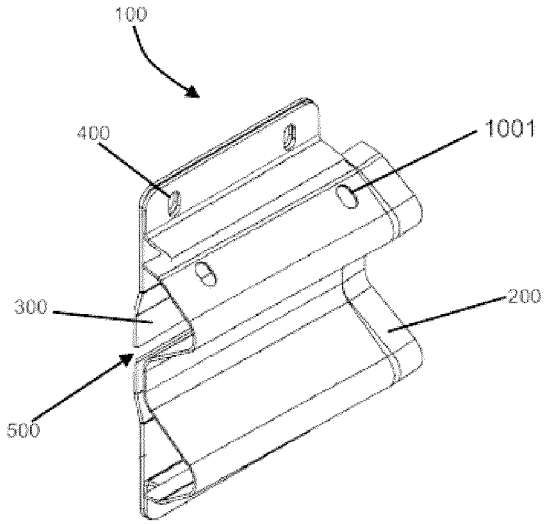
FIG. 2 shows a front perspective view of the embodiment shown in FIG. 1.

In the Figures there is shown a slider assembly generally indicated by arrow 100 which is utilised in a guardrail 1000. The slider assembly (slider) has a front section 200 and a back section 300. As can be seen the front section 200 has a substantially W shaped cross section which corresponds to the cross section profile of a W beam rail (not shown) and the back section is by comparison substantially planar in nature. The top and bottom edges of the front and back sections are held together with bolts (not shown) which pass through corresponding apertures 400 in the front and back sections 200, 300. As can be seen the back section has a horizontal slot 500 therein which is open to the upstream edge 600 of the back section. The slider assembly has a first opposed portion 700 and a second opposed portion 701.

Figure 3:
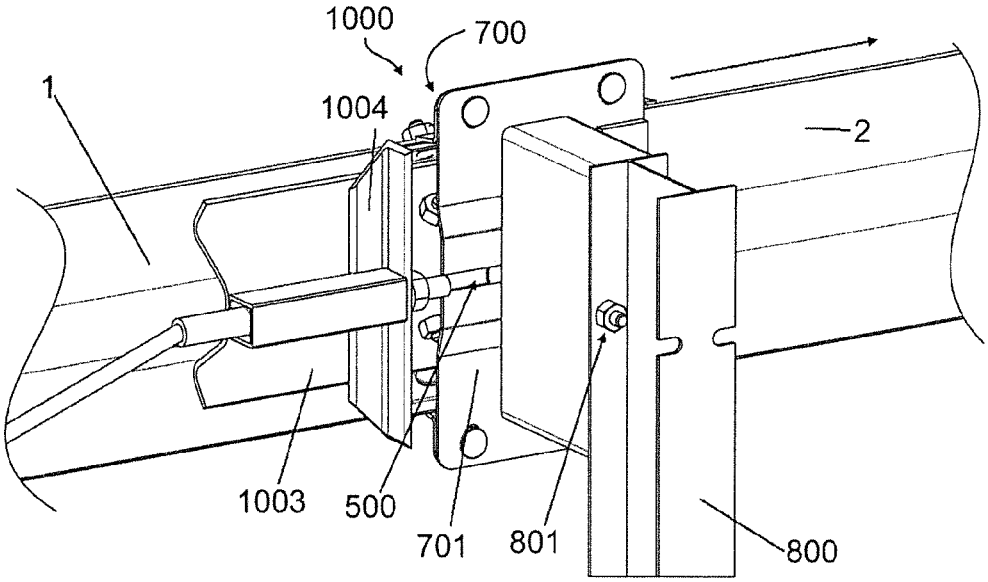
FIG. 3 shows a side view slider assembly forming part of a guardrail prior to impact.

The slot 500, in use, enables a post bolt 801 to attach the slider assembly to a post 800 and helps prevent the rails 1 and 2 dropping to the ground during a side impact—see FIG. 3. The front section 200 is also in use connected to the downstream end of a first rail 1 in a guardrail 1000 via bolts (not shown) which pass through apertures 1001 in the front section. The slider 100 accommodates via an internal space 800 the first rail 1 as well as the second rail 2 which is attached via bolts (not shown) to a slider bracket 1003 which has a stop in the form of an angle bar 1004 welded thereto. Thus, the slider 100 holds rails 1 and 2 together. The purpose of the slider bracket 1003 and angle bar 1004 is to prevent the end of rail 2 being pulled through the slider assembly 100 during a side on impact with the guardrail which would otherwise cause separation of rails 1 and 2 (i.e. gating). The angle bar 1004 is larger dimensionally than the slider assembly which accommodates rails 1 and 2 therein thus the angle bar prevents rails 1 and 2 separating during a side on impact to enable the guardrail to fully redirect an errant vehicle hitting the guardrail in a side angled impact.

Figure 4:
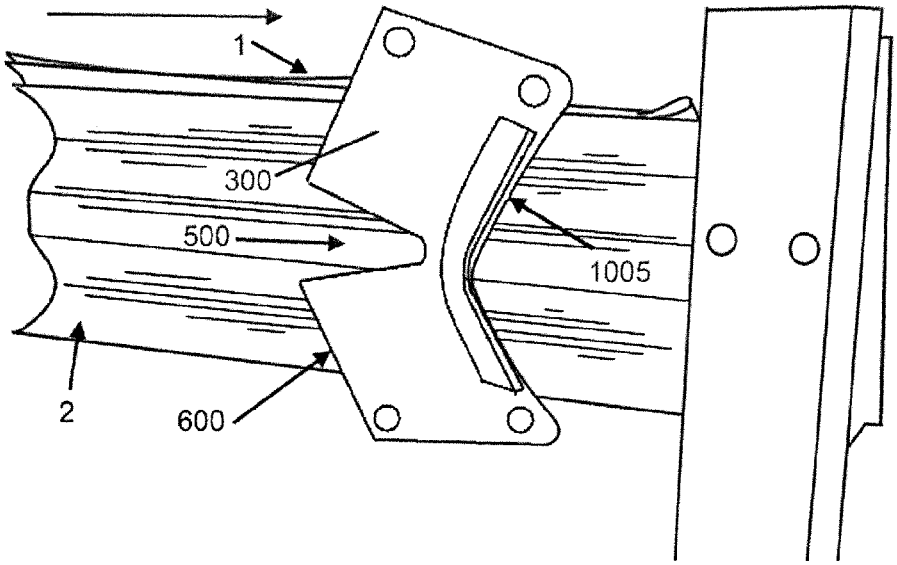
FIG. 4 shows a slider assembly as shown in FIG. 3 post impact.
Figure 5:
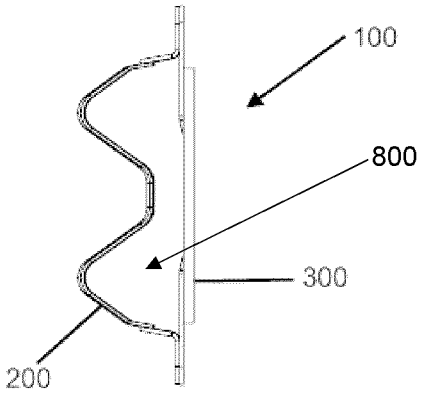
FIG. 5 shows a substantially end on view of a slider assembly and guardrail prior to impact.

Additionally, the slot 500 also enables the slider assembly 100 to deform into a friction brake which clamps (compresses) onto downstream rails as it travels down the guardrail gathering telescoping rails during a head on impact—refer FIG. 4. This deformation of the slider occurs as the downstream edge 1005 of the back section 300 impacts with post bolts holding the rails to posts, as the slider travels down the rails. These post bolt impacts progressively push in and increasingly dent the downstream edge 1005 of the back slider section 300. This denting causes the two edges of the slot 500 to splay at the upstream edge 600—refer FIG. 4. As a consequence the first opposed portion 700 and second opposed portion 701 in the form of the top and bottom portions of the front edge of the slider compress onto the top and bottom of the rails on which the slider is being pushed along by the energy of the end impact. As more post bolts are encountered as the slider travels down the guardrail the downstream edge gets deformed further and the clamping force increases such that the slider can impart more of a frictional braking effect to slow the vehicle down and absorb the impact energy.

Figure 6:
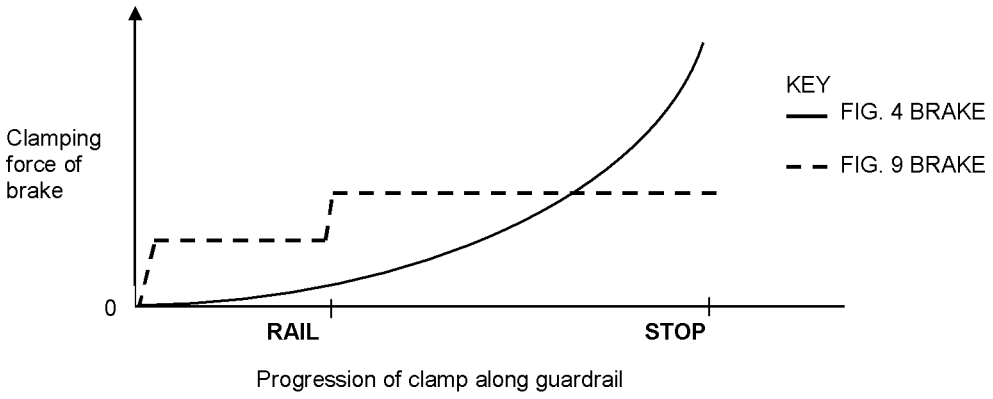
FIG. 6 shows a graph illustrating how the sliders (friction brakes) of FIG. 4 and FIG. 9 apply a progressively increasing clamping force to help absorb energy.

In FIG. 6 there is provided a graph which diagrammatically how illustrates the theory of different embodiments of friction brakes can apply the clamping force as the slider (friction brake) moves along rails which are telescoping with respect to one another.

Figure 7:
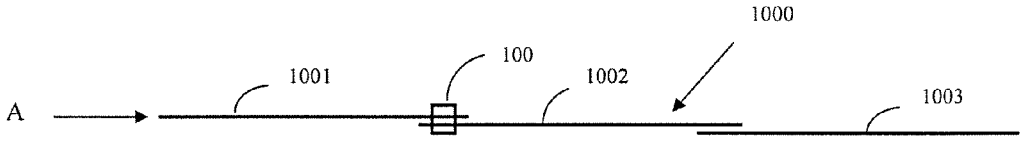
FIGS. 7 and 8 respectively shows a guardrail which includes a slider the guardrail being pre-head-on impact in FIG. 7 and post-head-on impact in FIG. 8.
Figure 8:
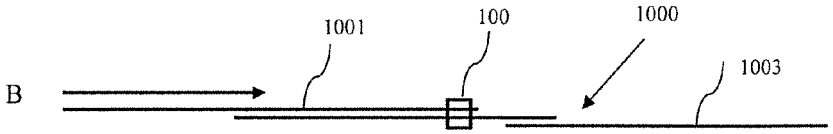

In FIGS. 7 and 8 there is shown a guardrail 1000 which has 3 adjacent terminal rails 1001-3 and a slider (friction brake) 100 connecting rails 1001 and 1002. The friction brake 100 is connected via bolts not shown to the terminal end of rail 1001 and is frictionally engaged (clamped) to rail 2 so that it can with sufficient force be slid along rail 2 so as to telescope.

In use, if a vehicle (not shown) impacts with the terminal end of the guardrail 1000 in direction shown by arrow A in FIG. 7, this causes the rails to telescope as shown in FIG. 8 as the rails 1001 and associated slider assembly (friction brake) 100, slide in direction B during the telescoping of the rail. Depending on the force of impact the telescoping may continue along rail 1003 and beyond—depending on how the friction brake is configured.

Figure 9:
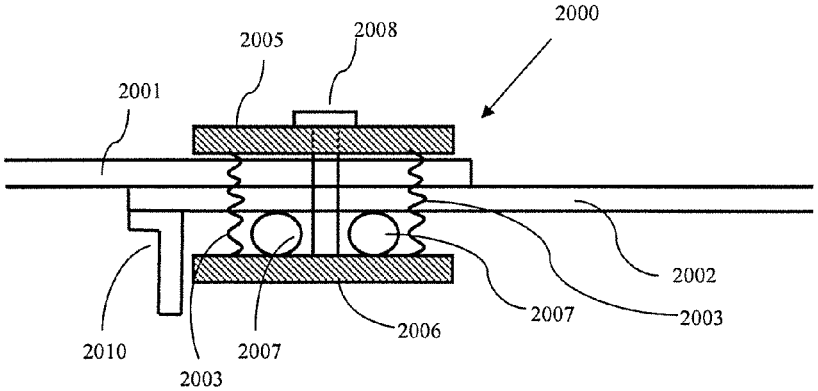
FIG. 9 shows schematic plan view of an alternative friction brake in another embodiment of the present invention.

In FIG. 9 there is shown an alternative slider assembly/friction brake 2000. The friction brake 2000 has a first opposed portion in the form of side wall 2005 and a second opposed portion in the form of side wall 2006 which are biased towards one another by an upstream and downstream pairs of upper and lower coil springs 2003. The upstream and downstream springs being located above and below the rails of the guardrails (thus it is only the upper springs which are visible in FIG. 9). The side wall 2005 which in use will be adjacent the terminal rail 2001 has apertures (not shown) so it can be bolted thereto at the downstream end thereof. The other side wall 2006 has rollers 2007, which allow for the friction brake 2000 to telescope along subsequent rails (such as rail 2002) in the guardrail, which are sequentially located downstream of the terminal rail 2004 to which the brake is attached (as mentioned earlier). A bolt 2008 provides an adjustment for altering the degree of friction imparted by the springs 2003. A bracket and stop 2010 arrangement in the form of an L-shaped member when view from above is connected to the end of second rail 2002. One arm of the L-Shaped member extends past the side wall 2006 to prevent rail 2002 from being pulled through the friction brake 2000 during side impacts.

It will be appreciated in certain embodiments that if the length of rails is relatively short say around 1 m compared to say a standard guardrail length of around 3 m the number of rails that telescope with respect to one another over a given distance is increased allowing for more energy to be absorbed in a shorter distance/period of time. Similarly, if the width of the telescoping rails is increased more energy can be absorbed over a shorter distance/period of time as this increases the compressive force applied during telescoping.

Figure 10:
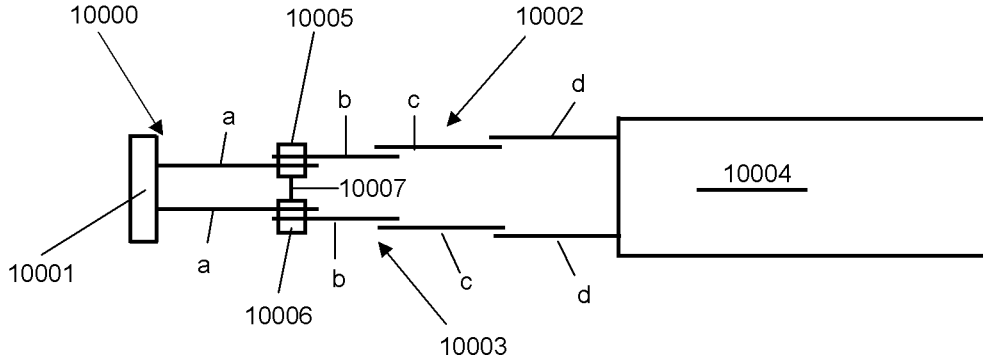
FIG. 10 shows a schematic plan view of an energy absorbing apparatus in accordance with a further embodiment of the present invention.

In FIG. 10 there is shown an energy absorbing apparatus 10000 which has an impact head 10001 two sets of spaced apart rails 10002 and 10003 each having rails a-d. The energy absorbing apparatus is constructed in front of a concrete barrier wall 10004 to guard against head on collisions injuring people. The energy absorbing apparatus 10000 has two slider assemblies 10005 and 10006 which are joined via a connecting member 10007. The slider assemblies are substantially identical to that shown in FIG. 9 and are connected to the rails in the manner previously described in relation to FIG. 9. The length of the rails in this embodiment is relatively short only being 1 m in length giving the energy absorbing apparatus a length of around 4 m.

The cross sectional shape of the front and/or back slider sections can vary dependent on the rail profile to be surrounded by the slider.

The front and back sections may be a single piece construction in some embodiments. This form of construction is fast and non-labour intensive. In some embodiments of this aspect the front and back sections may be formed by folding a single piece of material.

In some other embodiments the front and back sections may be of two piece construction. This construction enables a slider to be fitted to the rails of a pre-constructed guardrail or other energy absorbing device. It will be appreciated that the folded slider embodiment also possesses this advantage.

The front and back sections or a portion thereof can be connected to one another in a variety of different ways.

For example:

- in some embodiments the front and back sections can be welded to one another;
- in some other embodiments the front and back sections can be bolted together; or
- in other embodiments the front and back section may be formed so as to interlock or otherwise engage with one another so as to form a connection there between.

The slider assembly is generally made of steel or the same material as the rails of a guardrail or other component on which the slider travels as part of another energy absorbing apparatus. However, provided the material from which the slider is made can differ from that of the portion of the guardrail or other energy absorbing apparatus on which it travels provided the material can:

- break post bolts;
- deform so as to act as a brake on the rails on which it is sliding; and
- retain telescoping rails.

It is envisaged that in addition to guardrails the present invention has application to other road safety barriers such as cable barriers or concrete barriers where the present invention can be used at the terminal ends thereof as part of an impact head assembly which utilises a slider assembly and a series of longitudinally aligned rails and post supports.

Aspects of the present invention have been described by way of example only and it should be appreciated that modifications and additions may be made thereto without departing from the scope of the appended claims.

What we claim is:

1. A guardrail assembly comprising a slider assembly and a guardrail, the slider assembly including:

a front section; and a back section including first and second opposed portions and a slot or gap between the first and second opposed portions, wherein the front section is profiled to conform to a cross sectional profile of a rail forming a terminal end of the guardrail, and wherein the front section in combination with the back section create an internal space therebetween, the internal space dimensioned, so as to surround both an associated first rail and an associated second rail of the terminal end, as well as at least two further rails located downstream of said first and second rail, and wherein the slot or gap between the first and second opposed portions forms a deformable region of the slider assembly that, upon deformation, enables the first and second opposed portions to move with respect to each other to reduce a dimension of the internal space, the reduction in the dimension, in use, applies an increasing compressive force to the associated first rail and the associated second rail of the terminal end, as well as the at least two further rails located downstream of said first and second rail as a consequence of the slider assembly travelling along one or more subsequent rail(s) during telescoping;

wherein the slider assembly has an upstream end and a downstream end and wherein the back section includes the slot or gap in the form of a substantially horizontal slit therein which opens only to an upstream edge of the back section.

2. The guardrail assembly as claimed in claim 1, wherein the assembly includes a bracket and stop configured to be attached to the second rail which, in use, help retain the second rail within the internal space of the slider during side on impacts where the second rail may experience a longitudinal pulling force.

3. An energy absorbing apparatus which includes two guardrail assemblies of the type claimed in claim 1 which are connected to one another in a manner which enables each of the respective slider assemblies to travel on a respective one of two parallel sets of rails.

4. An energy absorbing apparatus which includes at least one slider assembly and a guardrail assembly, the slider assembly including opposing sections defining an internal space configured to receive multiple rails of the guardrail assembly, one of said sections comprising first and second opposed portions wherein the first and second opposed portions including a slot or gap therebetween, the slot or gap forming a deformable region of the slider assembly that, upon deformation, enables the first and second opposed portions to be movable with respect to each other to reduce a dimension of the internal space, the reduction in the dimension applying an increasing compressive force to telescoping rails of the guardrail assembly as a consequence of the slider assembly travelling along one or more subsequent rail(s) of the guardrail assembly during telescoping;

wherein the slider assembly has an upstream end and a downstream end and wherein a back section of the slider assembly includes the slot or gap in the form of a substantially horizontal slit therein which opens only to an upstream edge of the back section.

5. A guardrail having a friction brake, the friction brake including a slider assembly including first and second opposed portions having a slot or gap therebetween, the slot or gap forming a deformable region of the slider assembly, the first and second opposed portions together surrounding at least a portion of a first terminal rail of the guardrail and which connect the first terminal rail to an adjacent terminal rail of the guardrail, wherein the friction brake is configured to slide along the adjacent terminal rail when the first terminal rail and the adjacent terminal rail telescope together during an impact and wherein the deformable region formed by the slot or gap enables, upon deformation, the first and second opposed portions to move with respect to each other so the first and second opposed portions progressively apply an increasing compressive force to the first terminal rail and the adjacent rail as the brake travels along the rails during an impact;

wherein the slider assembly has an upstream end and a downstream end and wherein a back section of the slider assembly includes the slot or gap in the form of a substantially horizontal slit therein which opens only to an upstream edge of the back section.

6. A guardrail assembly comprising a slider assembly and a guardrail, the slider assembly including:

a first section; and a second section, one of said first and second sections including opposing portions and a gap between the opposing portions, wherein one of the first and second sections is profiled to conform to a cross sectional profile of a rail forming a terminal end of the guardrail, and the combination of the first and second sections creates an internal space between the first and second sections, the internal space dimensioned so that in use, the first and second sections substantially surround both an associated first rail and an associated second rail of the terminal end, as well as at least two further rails located downstream of the first and second rail, and wherein the gap between the opposing portions forms a deformable region, which upon deformation enables the opposing portions to move with respect to each other to apply an increasing compressive force to the associated first rail and the associated second rail of the terminal end, as well as the at least two further rails located downstream of the first and second rail as the slider assembly travels along one or more subsequent rails during telescoping;

wherein the slider assembly has an upstream end and a downstream end and wherein a back section of the slider assembly includes the gap in the form of a substantially horizontal slit therein which opens only to an upstream edge of the back section.

* * * * *